US006857630B2

(12) United States Patent
Yu

(10) Patent No.: US 6,857,630 B2
(45) Date of Patent: Feb. 22, 2005

(54) PAPER PICKUP MECHANISM

(75) Inventor: Cheng-Hui Yu, Hualien (TW)

(73) Assignee: Lite-On Technology Corporation, Taipei (TW)

( * ) Notice: Subject to any disclaimer, the term of this patent is extended or adjusted under 35 U.S.C. 154(b) by 104 days.

(21) Appl. No.: 10/294,118

(22) Filed: Nov. 14, 2002

(65) Prior Publication Data

US 2003/0178762 A1 Sep. 25, 2003

(30) Foreign Application Priority Data

Mar. 25, 2002 (TW) ..... 91203660 U

(51) Int. Cl.[7] ..... B65H 3/06
(52) U.S. Cl. ..... 271/116; 271/118; 271/117
(58) Field of Search ..... 271/117, 118

(56) References Cited

U.S. PATENT DOCUMENTS 5,624,109 A * 4/1997 Tanaka ..... 271/10.13
6,168,147 B1 * 1/2001 Nose et al. ..... 271/10.13
6,497,405 B2 * 12/2002 Yu et al. ..... 271/116

* cited by examiner

*Primary Examiner*—Donald P. Walsh
*Assistant Examiner*—Kaitlin Joerger
(74) *Attorney, Agent, or Firm*—Apex Juris, pllc; Tracy M Helms

(57) ABSTRACT

A paper pickup mechanism for automatically picking up a paper is provided. The paper pickup mechanism includes a system motor for proceeding a first-direction rotation, and a second-direction rotation, a mounting shaft switching between a starting position and a pickup position, a first device driven by the system motor, and a second device driven by the first drive device, wherein the mounting shaft is driven by the first device to be switched from the starting position to the pickup position till the mounting shaft is limited by the paper while the system motor proceeds the first-direction rotation and the second device suffers an external force having a value less than a threshold, while the value of the external force suffered by the second device is larger than the threshold, so that the second drive device is started to move the paper, and while the system motor proceeds the second-direction rotation and the second device suffers the external force having the value less than the threshold, the mounting shaft is driven by the first device to be restored from the pickup position to the starting position.

5 Claims, 4 Drawing Sheets

PAPER PICKUP MECHANISM

FIELD OF THE INVENTION

This invention relates to a paper pickup mechanism, and more particularly to a paper pickup mechanism with a mounting shaft for automatically picking up a slight paper.

BACKGROUND OF THE INVENTION

An automatic paper pickup mechanism is a very important portion of many official machines, such as printers, facsimile machines, and copying machines. The automatic paper pickup mechanism can automatically feed a stack of paper once a page into the official machine for proceeding follow-up actions, for example, printing, faxing, and copying. And, a paper pickup mechanism with a mounting shaft is a general one. In the conventional technologies, for example, an ACM (Auto Compensation Mechanism) of U.S. Pat. No. 5,527,026, the mounting shaft for picking up the paper is located at the pick-up position so as to contact with the paper, but, under this condition, if the paper is soft and slight and has less rigidity, the mounting shaft will not be urged by the paper to locate at a correct position which will always get the paper stuck. In addition, for solving the paper stuck problem described above, some other prior arts utilize a system motor to provide the power for feeding paper and additionally employ an expensive electromagnetic valve or another reserved motor for driving the mounting shaft. However, these structures cause the paper mechanism more complicated and also cost more.

It is clear that because the mounting shaft of the conventional paper pickup mechanism can not automatically move up and down, it will cause the soft and slight paper to get stuck and further bother the user. Simultaneously, if the structure of the paper pickup mechanism for moving the mounting shaft automatically becomes more complicated and the manufacturing cost increases, the competitiveness of the product will be seriously influenced. Consequently, how to move the mounting shaft automatically under a simplest mechanism for solving the paper stuck problem and reducing the cost becomes the main purpose of the present invention.

SUMMARY OF THE INVENTION

It is an object of the present invention to provide a paper pickup mechanism which can be automatically moved up and down only by employing the obverse and reverse rotation of one system motor.

It is another object of the present invention to provide a paper pickup mechanism which can prevent the soft and slight paper to get stuck by means of the reacting force produced by rubbing against the feeding paper for supplementing the friction so as to guarantee the success of the paper pickup.

According to an aspect of the present invention, a paper pickup mechanism for automatically picking up a paper includes a system motor for proceeding a first-direction rotation, and a second-direction rotation, a mounting shaft switching between a starting position and a pickup position, a first device driven by the system motor, and a second device driven by the first drive device, wherein the mounting shaft is driven by the first device to be switched from the starting position to the pickup position till the mounting shaft is limited by the paper while the system motor proceeds the first-direction rotation and the second device suffers an external force having a value less than a threshold, while the value of the external force suffered by the second device is larger than the threshold, so that the second drive device is started to move the paper, and while the system motor proceeds the second-direction rotation and the second device suffers the external force having the value less than the threshold, the mounting shaft is driven by the first device to be restored from the pickup position to the starting position.

Preferably, the first device includes a first gear driven by the system motor, a transmission shaft jointed with the first gear, and a second gear sleeving around the transmission shaft for driving the second device.

Preferably, the mounting shaft is pivoted on the transmission shaft when the second device suffered the external force having the value less than the threshold.

Preferably, the second device includes a connecting shaft, a third gear jointed on the connecting shaft and engaged with the second gear of the first device, and a torque limiting module on the connecting shaft for limiting the third gear to rotate around the connecting shaft when the third gear suffers the external force having the value larger than the threshold.

Preferably, the second device further includes a pickup roller for sleeving around the connecting shaft and connecting with the third gear, wherein the mounting shaft is driven along with the first-direction rotation proceeded by the system motor to rotate around the transmission shaft so as to switch from the starting position to the pickup position for contacting the pickup roller with a top of the paper while the system motor proceeds the first-direction rotation and the second device suffers the external force having the value less than the threshold, when the pickup roller urging against the paper produces a reacting force causing the external force having the value larger than the threshold, the pickup roller starts rotating to displace the paper, and then when the system motor proceeds the second-direction rotation and the second device suffers the external force having the value less than the threshold, the mounting shaft is driven along with the second-direction rotation proceeded by the system motor to counter rotate around the transmission shaft so as to be switched from the pickup position to the starting position for providing a distance between the pickup roller and the paper.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

Figure 1:
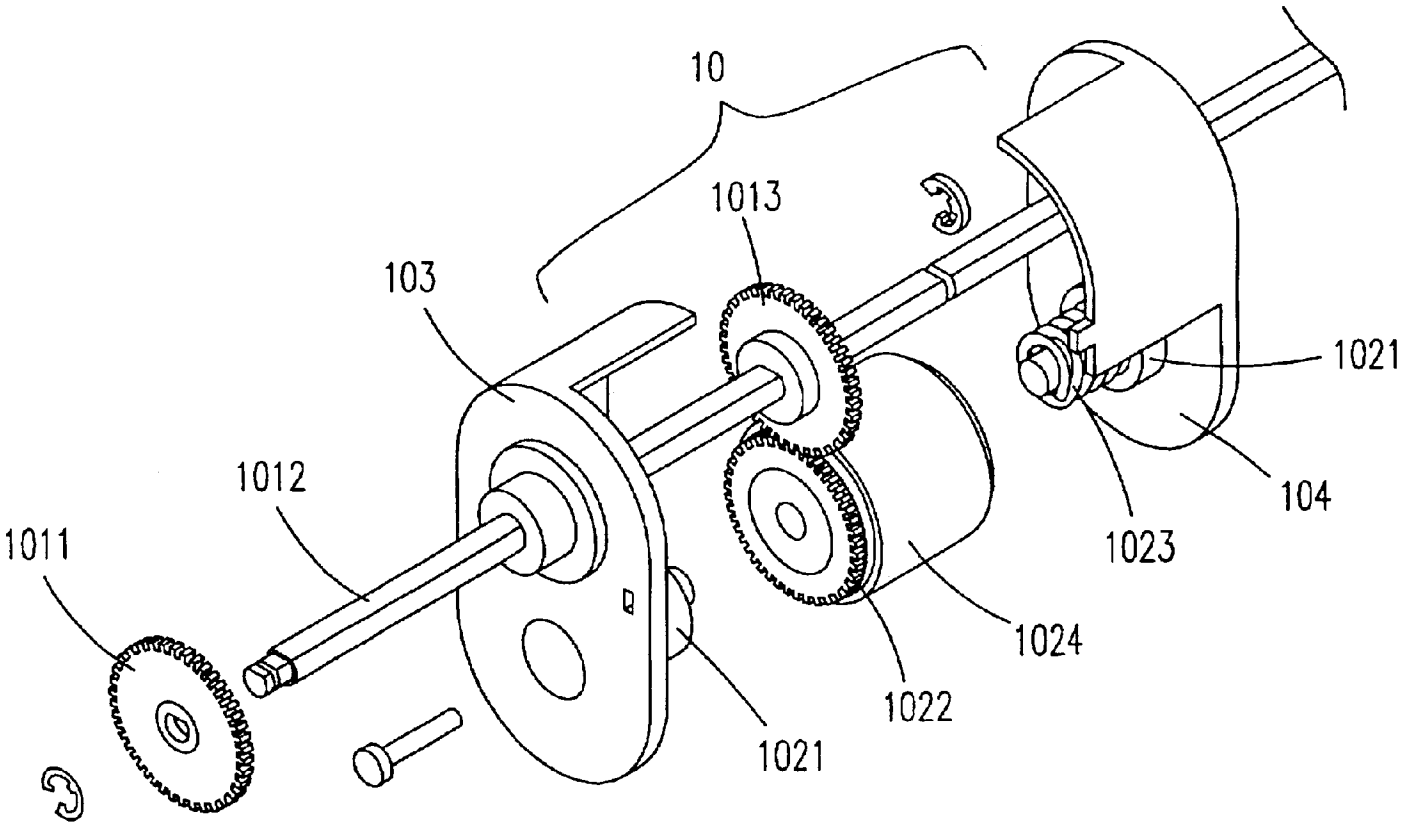
FIG. 1 is a structural view showing the paper pickup mechanism of the preferred embodiment according to the present invention.

FIG. 1 shows the structural view of the paper pickup mechanism in the preferred embodiment according to the present invention. As shown in FIG. 1, the paper pickup mechanism includes a system motor (not shown) and a mounting shaft 10. The system motor can proceed a first-direction rotation and a second-direction rotation. The mounting shaft 10 includes a first device and a second device, wherein the first device includes a first gear 1011, a transmission shaft 1012, and a second gear 1013, and the second device includes a connecting shaft 1021, a third gear 1022, a torque limiting module 1023, and a pickup roller 1024.

In the first device, the first gear 1011 is driven by the system motor so as to drive the transmission shaft 1012 which is jointed therewith, and the second gear 1013 sleeves around the transmission shaft 1012 for driving the third gear 1022 of the second device. Furthermore, the mounting shaft 10 is consisted by an upper cover 103 and a base 104, and the transmission shaft 1012 sleeves around the upper cover 103 and the base 104.

Regarding to the second device, the connecting shaft 1021 of the second device is fixedly connected to the upper cover 103 and the base 104, and the third gear 1022 sleeves around the connecting shaft 1021 and engages with the second gear 1013 of the first device. Moreover, the torque limiting module 1023 which is set on the connecting shaft 1021 can provide a torque to the third gear 1022 for resisting a rotation caused by the connecting shaft 1021. However, when the third gear 1022 suffers an external force having a value larger than a threshold, it will then be rotated by the connecting shaft 1021. And, the pickup roller 1024 also sleeves around the connecting shaft 1021 and engages with the third gear 1022.

Figure 2A:
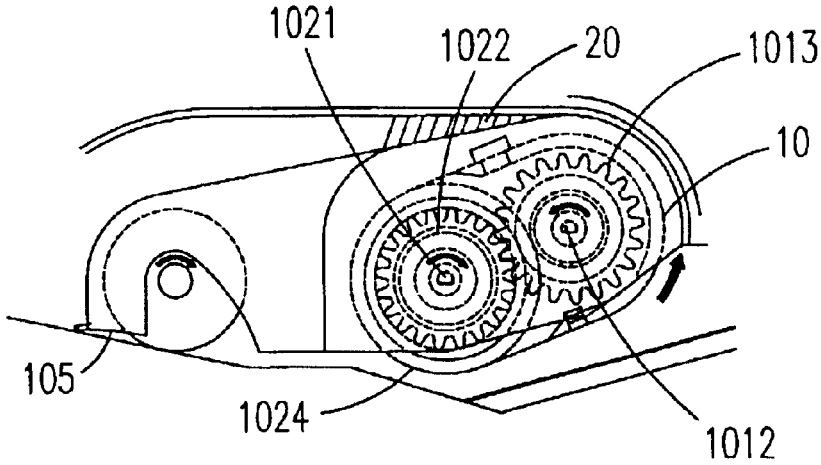
FIGS. 2(A)~2(F) are schematic views of the continuous motions in the preferred embodiment according to the present invention.
Figure 2B:
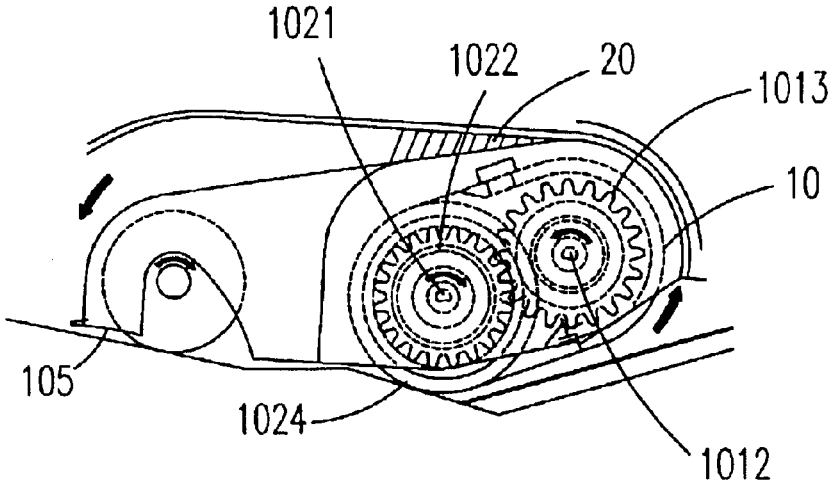
Figure 2C:
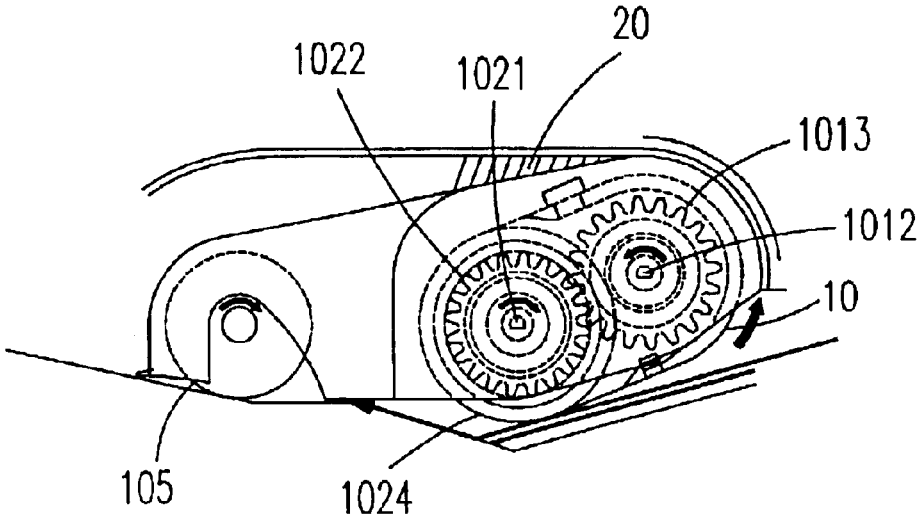

Please further refer to FIGS. 2(A)~2(F) illustrating the schematic views of the continuous motions in the preferred embodiment according to the present invention. In FIG. 2(A), it shows the starting position of the mounting shaft 10. At the beginning, the system motor starts to proceed a first-direction rotation which will also drive the transmission shaft 1012 and the second gear 1013 to rotate. However, if the external force suffered by the third gear 1022 has a value less than the threshold because of the limiting by the torque limiting module 1023, the system motor will fail to drive the engaged second gear 1013 and third gear 1022. Thus, the power produced by the system motor will then drive the whole mounting shaft 10 to rotate down through the transmission shaft 1012, the mounting shaft 10 will gradually switch from the starting position to the pickup position, and it results the pickup roller 1024 to be contacted with the paper (as shown in FIG. 2(B)). Continuously, a reacting force will be suffered by the pickup roller 1024 because the pickup roller 1024 is contacted with the paper. The reacting force causes the external force suffered by the second device to have a value larger than the threshold which results in the third gear 1022 to overcome the torque limiting module 1023 and proceed a rotation caused by the transmission shaft 1012. Accordingly, the pickup roller 1024 will be driven to rotate so as to start feeding the paper (as shown in FIG. 2(C)).

Figure 2D:
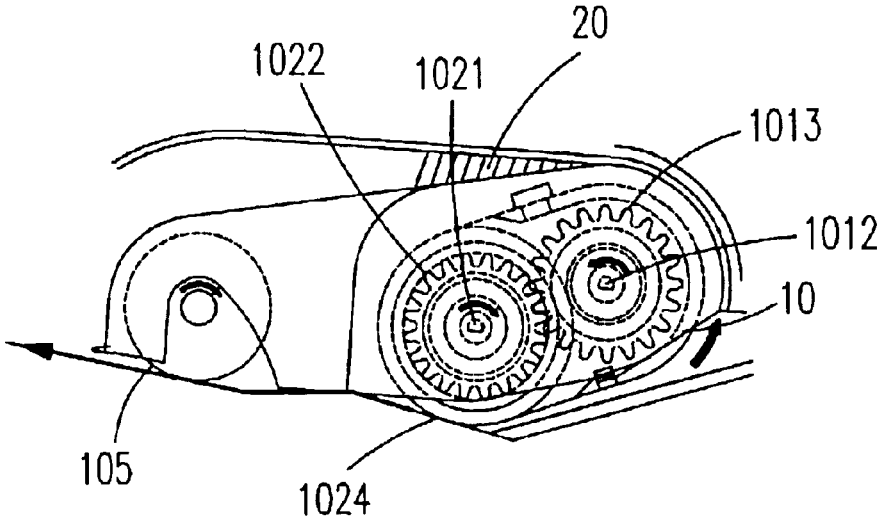
Figure 2E:
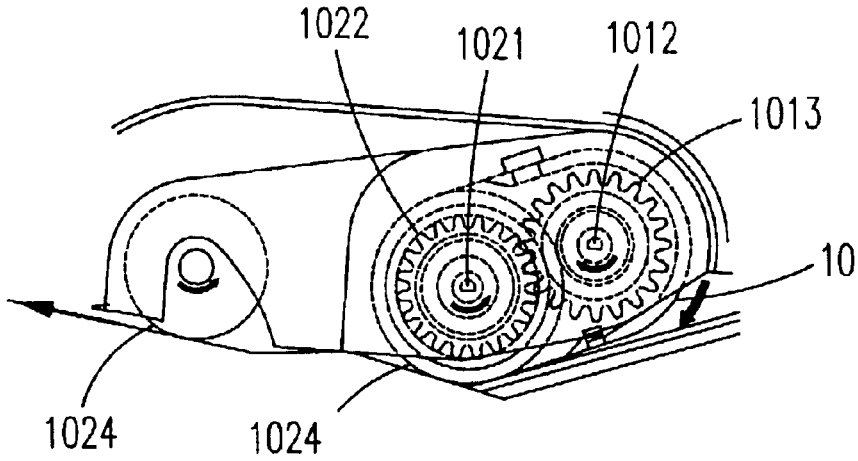
Figure 2F:
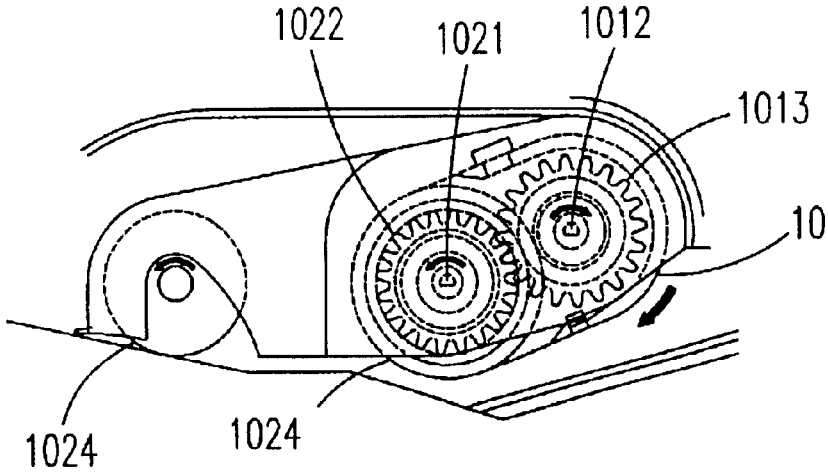

Please then refer to FIG. 2(D). The paper is moved to a deliver roller 105 by the pickup roller 1024 for being transmitted continuously. Until the paper is driven by another roller downstream (not shown), the system motor will be changed to proceed the counter directional second-direction rotation which will simultaneously drive the transmission shaft 1012 and the second gear 1013. At this time, also because of the torque limiting module 1023, the third gear 1022 which is engaged with the second gear 1013 will again suffer the external force having a value less than the threshold, so that it will not overcome the limitation to rotate. Identically, the power of the system motor will drive the whole mounting shaft 10 to rotate up through the transmission shaft 1012 (as shown in FIG. 2(E)), the mounting shaft 10 will gradually switch from the pickup position to the starting position (reject to the boundary 20), and it results the pickup roller 1024 to be displaced the paper (as shown in FIG. 2(F)). At this point, a reacting force produced by the contact with the boundary 20 will still cause the external force suffered by the third gear 1022 to have a value larger than the threshold which results the third gear 1022 to overcome the torque limiting module 1023, proceed a counter rotation and drive the pickup roller 1024 to rotate. However, this will not cause any influence because the pickup roller is a distance away the paper.

According to the preferred embodiment described above, the structure of the present invention utilizes the single motor system and the torque limiting module to drive the mounting shaft to automatically move up and down without contacting with the paper at the beginning. Therefore, even when the paper is soft and slight, the situation that the mounting shaft can not be switched to a correct position because of the insufficient rigidity of the paper will not be happened again. Simultaneously, the mounting shaft of the present invention also can save the expansive electromagnetic valve or another motor for driving the mounting shaft in the prior arts. Furthermore, the number of the gears in the paper pickup mechanism is fewer, too. Consequently, the main purposes of the present invention for solving the defects of complicated structure and high manufacturing cost are achieved.

In view of the aforesaid, the paper pickup mechanism of the present invention eliminates the paper stuck problem which is caused by the insufficient rigidity of the soft and slight paper during transmission. Furthermore, compared with the prior arts, the paper pickup mechanism is an uncomplicated structure. Thus, this is a paper pickup mechanism which can solve the permanent paper stuck problem. In addition, the technology of the present invention can also be utilized by the important tools of the products in different fields, such as printers, fax machines, and copying machines. Consequently, the present invention is a significant improvement and development.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A paper pickup mechanism for automatically picking up a paper, comprising:

a system motor for proceeding a first-direction rotation, and a second-direction rotation;

a mounting shaft switching between a starting position and a pickup position;

a first device driven by said system motor; and a second device driven by said first drive device, wherein said mounting shaft is driven by said first device to be switched from said starting position to said pickup position till said mounting shaft is limited by said paper while said system motor proceeds said first-direction rotation and said second device suffers an external force having a value less than a threshold, while said value of said external force suffered by said second device is larger than said threshold, so that said second drive device is started to move said paper, and while said system motor proceeds said second-direction rotation and said second device suffers said external force having said value less than said threshold, said mounting shaft is driven by said first device to be restored from said pickup position to said starting position.

2. The mechanism according to claim 1 wherein said first device comprises:

a first gear driven by said system motor;

a transmission shaft jointed with said first gear; and a second gear sleeving around said transmission shaft for driving said second device.

3. The mechanism according to claim 2 wherein said mounting shaft is 9 pivoted on said transmission shaft.

4. The mechanism according to claim 2 wherein said second device comprises:

a connecting shaft;

a third gear jointed on said connecting shaft and engaged with said second gear of said first device; and a torque limiting module on said connecting shaft for limiting said third gear to rotate around said connecting shaft when said third gear suffers said external force having said value larger than said threshold.

5. The mechanism according to claim 4 wherein said second device further comprises:

a pickup roller for sleeving around said connecting shaft and connecting with said third gear, wherein said mounting shaft is driven along with said first-direction rotation proceeded by said system motor to rotate around said transmission shaft so as to switch from said starting position to said pickup position for contacting said pickup roller with a top of said paper while said system motor proceeds said first-direction rotation and said second device suffers said external force having said value less than said threshold, when said pickup roller urging against said paper produces a reacting force causing said external force having said value larger than said threshold, said pickup roller starts rotating to displace said paper, and then when said system motor proceeds said second-direction rotation and said second device suffers said external force having said value less than said threshold, said mounting shaft is driven along with said second-direction rotation proceeded by said system motor to counter rotate around said transmission shaft so as to be switched from said pickup position to said starting position for providing a distance between said pickup roller and said paper.

* * * * *